US008904688B1

(12) United States Patent
Rue et al.

(10) Patent No.: US 8,904,688 B1
(45) Date of Patent: Dec. 9, 2014

(54) PICTURE FRAME WITH PROTECTIVE COVER AND INTERCHANGABLE CANVAS

(71) Applicants: James S. Rue, Seven Devils, NC (US); Carolyn A. Crocker, Seven Devils, NC (US)

(72) Inventors: James S. Rue, Seven Devils, NC (US); Carolyn A. Crocker, Seven Devils, NC (US)

( * ) Notice: Subject to any disclaimer, the term of this patent is extended or adjusted under 35 U.S.C. 154(b) by 0 days.

(21) Appl. No.: 13/999,315

(22) Filed: Feb. 10, 2014

(51) Int. Cl.
*A47G 1/06* (2006.01)

(52) U.S. Cl.
CPC ..... *A47G 1/06* (2013.01)
USPC ..... 40/711; 40/781; 40/600; 40/661.01

(58) Field of Classification Search
CPC ... A47G 2001/0672; A47G 1/06; A47G 1/14; G09F 7/04; G09F 1/12
USPC ..... 40/711, 777, 780, 781, 661.01, 666
See application file for complete search history.

(56) References Cited

U.S. PATENT DOCUMENTS 5,787,625 A * 8/1998 Yesbick ..... 40/718
2014/0109450 A1* 4/2014 Valois ..... 40/711

* cited by examiner

*Primary Examiner* — Casandra Davis
(74) *Attorney, Agent, or Firm* — Robert G. Rosenthal

(57) ABSTRACT

A frame is adapted to hold a canvas that comprises a molding constructed and arranged to form a picture frame. The picture frame includes a front viewer facing side and rear wall facing side and a central opening defined by the molding. Additionally, a rabbet extends about the peripheral edge of the molding proximate the opening on the wall facing side. A removable protective covering covers in contacting overlying relation the molding. A canvas has a front viewer side and a rear wall facing side, the canvas being constructed and arranged to overlie and cover the opening and the protective covering when the protective covering is in place over the molding. A first magnet for detachably mounting said canvas to the front side of the frame is operatively associated with the canvas and a second magnet is operatively associated with the frame, the respective first and second magnets being constructed and arranged to cooperate with each other in magnetic attracting relation to maintain the canvas in place over the frame opening.

17 Claims, 4 Drawing Sheets

PICTURE FRAME WITH PROTECTIVE COVER AND INTERCHANGABLE CANVAS

FIELD OF THE INVENTION

This invention relates generally to the field of artist's materials and more specifically to a picture frame having a protective cover and easily interchangeable canvases.

BACKGROUND OF THE INVENTION

Paintings and frames have been paired together for centuries as proper frame selection enhances the presentation and enjoyment of the artwork. A picture frame comprises a shaped molding and a rabbet into which the painting is inserted from the rear which semi-permanently mounts the artwork therein. For example, nails are often driven through the wooden stretcher bars of the canvas support into the frame. Alternatively, brackets may be used, one end of which is screwed into the frame and the other end overlies the reverse of the artwork and holds the artwork in place in the frame. Thus, it will be seen that removing a painting from its frame and replacing it with a new work is somewhat involved and opens up the possibility that the art may be damaged.

Another aspect to be considered when art is displayed is the desire of artists, collectors, museums or parents of children that paint may want to change or "swap out" paintings as new works are acquired or created Plein air painting or painting out of doors from nature is well known and has been a technique long employed by artists since the beginnings of the Impressionist Movement. This practice continues today and many artists enjoy painting from nature. They may paint a study or the finished work out of doors. Often these artists are approached by customers who want to purchase the work directly from the artist on the spot. In these cases it would be advantageous for the artist to be able to supply the purchaser with a suitable frame at the time of sale.

In some cases the artist may want to paint with the canvas in place on the frame. Frames that are currently available do not provide any protection from paint dripping or splattering on to the frame.

Accordingly, it is an object of the present invention to provide an improved picture frame.

A further object of the present invention is to provide an improved picture frame and canvas combination.

Yet another object of the present invention is to provide a picture frame wherein the canvas may be easily removed.

Still another object of the present invention is to provide a picture frame and canvas combination such that the canvas is easily interchangeable.

An additional object of the present invention is to provide a picture frame that is protected from paint spills when the artist paints with the canvas mounted on the frame.

SUMMARY OF THE INVENTION

The benefits and advantages of the present invention are achieved by providing a frame adapted to hold a canvas that comprises a molding constructed and arranged to form a picture frame. The picture frame includes a front viewer facing side and rear wall facing side and a central opening defined by the molding. Additionally, a rabbet extends about the peripheral edge of the molding proximate the opening on the wall facing side. A removable protective covering covers in contacting overlying relation the molding. A canvas has a front viewer side and a rear wall facing side, the canvas being constructed and arranged to overlie and cover the opening and the protective covering when the protective covering is in place over the molding. A first magnet for detachably mounting said canvas to the front side of the frame is operatively associated with the canvas and a second magnet is operatively associated with the frame, the respective first and second magnets being constructed and arranged to cooperate with each other in magnetic attracting relation to maintain the canvas in place over the opening.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE ILLUSTRATED EMBODIMENT

Figure 1:
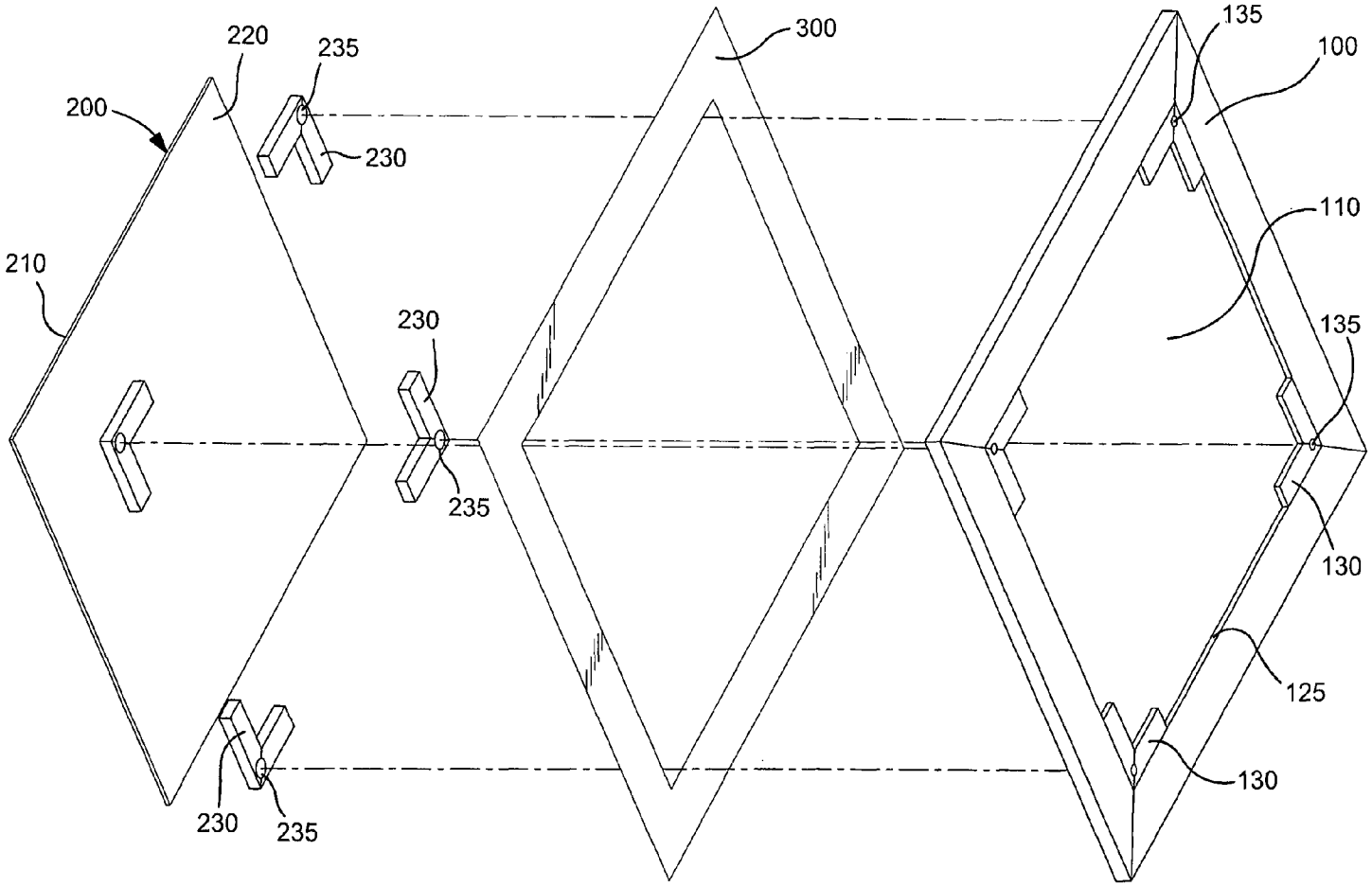
FIG. 1 is an exploded view of the picture frame and canvas according to the present invention.
Figure 2:
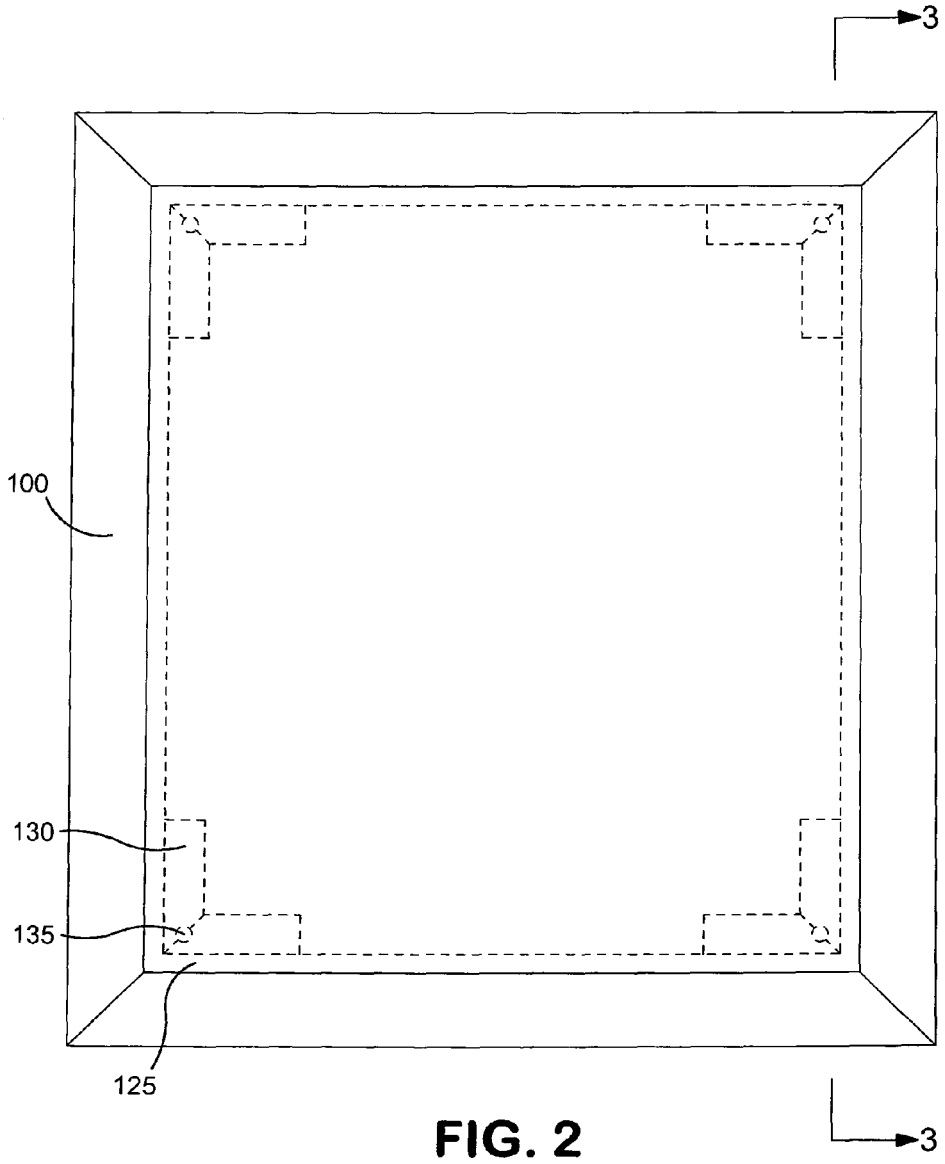
FIG. 2 is a plan view of the picture frame and canvas according to the present invention.
Figure 3:
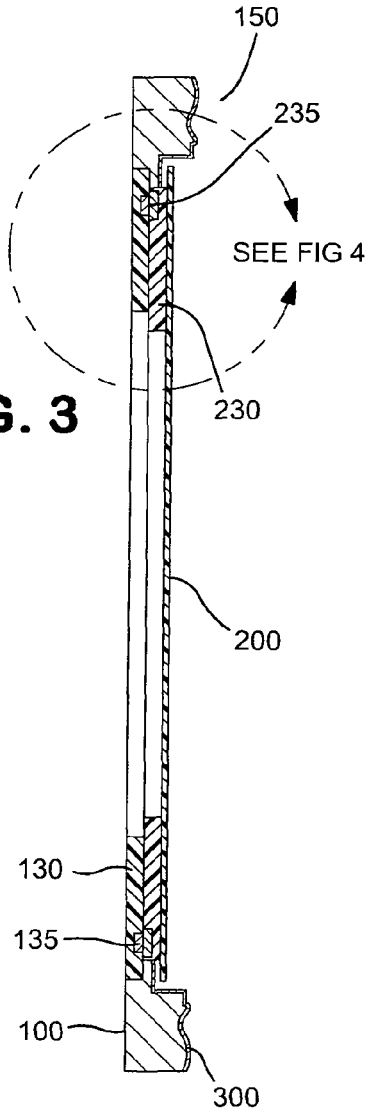
FIG. 3 is an end view of the picture frame and canvas take along line 3-3 of FIG. 2 according to the present invention.
Figure 4:
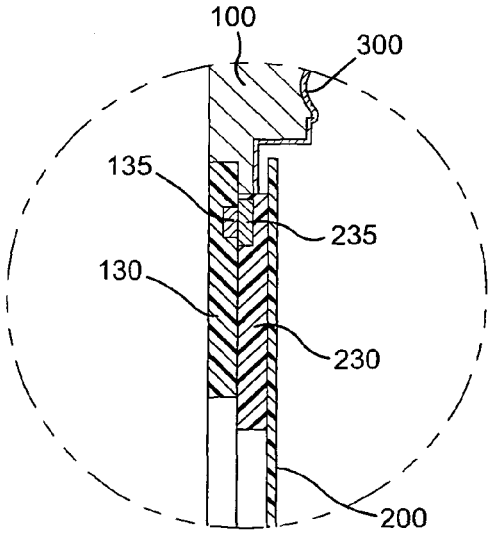
FIG. 4 is an enlarged view of the area within the dotted lines of FIG. 3 according to the present invention.
Figure 5:
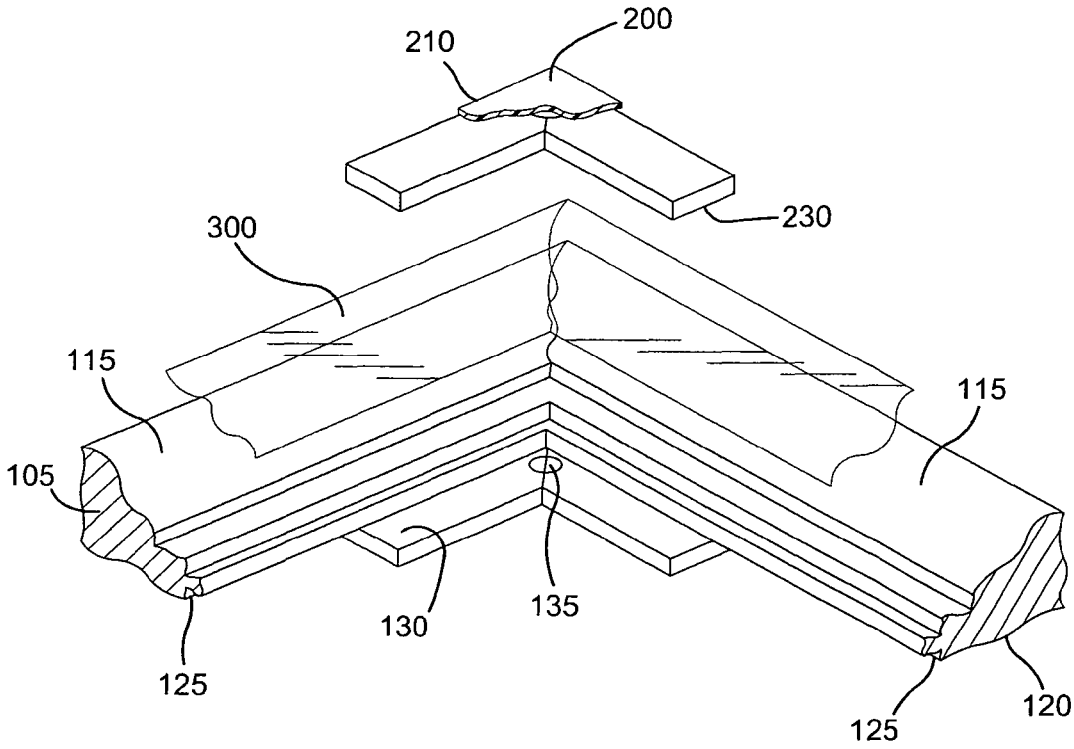
FIG. 5 is a perspective view, partially exploded and broken away illustrating the picture frame and canvas according to the present invention.

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate art and not a limiting upon the present invention.

Referring more specifically to the drawings and particularly to Figures, the present invention comprises a picture frame generally indicated at 100, a canvas generally indicated at 200 and a protective cover 300.

The picture frame 100 comprises a molding 105 constructed and arranged to form the rectangular frame that has a central opening 110 into which the artwork is inserted from the rear. The picture frame 100 comprises a front viewer facing side 115 and a rear wall facing side 120. A rabbet 125 extends about the peripheral edge of the molding 105 proximate opening 110 on the wall facing side 120. A mounting block 130 is attached to the rabbet 125 in each corner of the frame 100. Embedded within each mounting block 130 is a first magnetic means or first magnet 135 which acts to attract and hold canvas 200 in place as more fully explained herein below.

The canvas 200 as illustrated in the figures comprises front viewer side 210 and a rear wall facing side 220. The canvas 200 is constructed and arranged to overlie and cover the frame opening 110. The canvas in the preferred embodiment comprises a canvas panel of the type commonly sold in art supply stores having a canvas wrapped around a board such as a wooden panel or a cardboard. Notwithstanding the foregoing, the present invention may be practiced with equal efficacy employing a canvas stretched over a wooden frame or other type of art receiving surface. Attached to real wall facing side of canvas 200 proximate each corner is an "L" shaped mounting block 230 that includes a magnetic means or magnet 235 operatively associated therewith. In the prototypes that were constructed the mounting block 230 was glued to the canvas. Each bracket includes an opening that is adapted to receive a magnet 235 and the magnets are held in place with glue, pressure fit or other suitable methods, well known to those skilled in the art.

A removable protective covering means or cover 300 for protectingly covering the molding 100 in contacting overlying relation is provided. Cover 300 is preferably fabricated out of plastic and is cut or molded to fit the profile of the particular frame. Further, cover 300 is removable and reusable.

The respective mounting blocks 130, 230 are constructed and arranged to substantially overlie one another when the canvas is in place on frame 100. Similarly, the respective magnetic means 135, 235 are also constructed and arranged to substantially overlie one another and may be any two magnetic or magnetizable items that attract each other, such as opposite polarity magnets or a magnet and a ferrous metal. The magnet means should be of sufficient strength to maintain the canvas in place on the frame 100. For example, in small frames a magnet and corresponding ferrous metal (i.e., iron washer or iron disc) should be sufficient to hold the canvas in place. In larger frames, magnets of opposing polarity were used, and in very large frames, rare earth magnets of opposite polarity were used. Depending upon the particular size and weight of the canvas/canvas board some experimentation may be used to determine the correct combination needed to hold the canvas in place on the frame. In the prototype that was constructed the respective magnetic means were countersunk in the respective mounting blocks 130, 230. Further, it will be noted that in the prototype four mounting blocks, each with magnetic means were used. However, it will be noted that the invention may function efficaciously with more or fewer mounting blocks and magnets, depending upon the size and weight of the canvas. Additionally, the mounting blocks need not be "L" shaped as other shapes, such as single elongate strips will also function.

At the point of purchase the frame 100 may be packaged with a canvasboard or canvas 200 in place on the frame with magnetic means 135, 235; the cover 300 being sandwiched there between. The package may also include additional canvases or canvas boards 200. Alternatively, the canvases or canvas boards 200 with mounting blocks 130, 230 and magnets 135, 235 already in place may be purchased separately.

The picture frame according to the present invention may be deployed in a variety of ways. For example, a canvas may be painted on an easel (or otherwise away from the frame) in the conventional manner, allowed to dry and mounted on the frame 100 without using the protective cover 300 frame as outlined above. Additionally, the canvas 200 may be painted in place on the frame 100 with protective cover 300 in place; when the paint is dry, the cover can be removed and the canvas mounted on the frame for display. Also, canvases 200 may be interchanged simply by pulling on canvas 200, breaking the magnetic bond between the opposing magnets 135, 235 and simply replacing it with a new canvas.

The foregoing embodiments and examples are to be considered illustrative, rather than restrictive of the invention, and those modifications which come within the meaning and range of equivalence of the claims are to be included therein.

That which is claimed is:

1. A frame adapted to hold a canvas and comprising:

a molding constructed and arranged to form a picture frame, said picture frame having a front viewer facing side and rear wall facing side and a central opening defined by said molding and further including a rabbet extending about the peripheral edge of said molding proximate said opening on the wall facing side;

a protective covering means for protestingly covering in contacting overlying relation said molding and further wherein said protective covering means is removable;

a canvas having a front viewer side and a rear well facing side, said canvas being constructed and arranged to overlie and cover said opening and said protective covering when said protective covering is in place over said molding;

a first magnetic means for detachably mounting said canvas to the front side of said frame operatively associated with said canvas and a second magnetic means operatively associated with said frame, said respective first and second magnetic means being constructed and arranged to cooperate with each other in magnetic attracting relation to maintain the canvas in place over said opening.

2. The frame according to claim 1 further including a first set of mounting blocks connected to the wall facing side of said canvas and a second set of mounting blocks connected to said rabbet in the corners thereof and wherein said first set of mounting blocks and said second set of mounting blocks are constructed and arranged to overlie one another when said canvas in positioned to overlie and cover said opening; and further wherein at least some of said respective first and second sets of mounting blocks include at least one of said magnetic means of sufficient strength to maintain said canvas in place over said opening.

3. The frame according to claim 2 wherein said first set of mounting blocks is connected to the wall facing side of said canvas and said second set of mounting blocks comprises a mounting block connected to each corner of said frame in the rabbet and wherein said second set of mounting blocks is adapted to overlie the corresponding first set of mounting blocks in magnetically attracting relation when said canvas is in place over said opening.

4. The frame according to claim 3 wherein said protective covering means is a clear plastic.

5. The frame according to claim 1 wherein said protective covering means comprises a plastic cover having the same profile as said picture frame and wherein said protective covering means is adapted to overlie and protect said picture frame.

6. The frame according to claim 5 wherein said protective covering means is selected from the group consisting of molded plastic, paper, plastic sheeting and clear plastic sheeting.

7. A frame adapted to hold a canvas and comprising:

a molding constructed and arranged to form a picture frame, said picture frame having a front viewer facing side and roar wall facing side and a central opening defined by said molding and further including a rabbet extending about the peripheral edge of said molding proximate said opening on the wall facing side;

a protective covering means for protectingly covering in contacting overlying relation said molding and further wherein said protective covering means is removable;

a canvas having a front viewer side and a rear wall facing side, said canvas being constructed and arranged to overlie and cover said opening;

a mounting block connected to at least two corners of said frame in the rabbet and a corresponding mounting block connected to the wall facing side of said canvas such that each of said canvas connected mounting blocks is adapted to overlie a corresponding one of said rabbet mounting blocks; and a first magnetic means for detachably mounting said canvas to the front side of said frame operatively associated with said canvas mounting blocks and a second magnetic means operatively associated with said frame mounting blocks, said respective first and second magnetic means being constructed and arranged to cooperate with each other in magnetic attracting relation to maintain the canvas in place over said opening.

8. The frame according to claim 7 wherein each of said magnetic means is countersunk into its corresponding mounting block and includes means for maintaining the magnetic means therein.

9. The frame according to claim 8 wherein said protective covering means comprises a molded clear plastic having the same contours as said molding such that the molding is visible there beneath and further, wherein said canvas is adapted to lie on top of said protective covering means.

10. The frame according to claim 9 wherein said protective covering means is adapted to removably lie between the viewer side of said frame and the wall side of said protective covering means in sandwich fashion.

11. The frame according to claim 10 wherein said protective covering means is constructed and arranged for multiple placements and removals from coveting said frame.

12. A frame adapted to hold a canvas and comprising:

a molding constructed and arranged to form a picture frame, said picture frame having a front viewer facing side and rear wall facing side and a central opening defined by said molding and further including a rabbet extending about the peripheral edge of said molding proximate said opening on the wall facing side;

a canvas having a front viewer side and a rear wall facing side, said canvas being constructed and arranged to overlie and cover said opening;

a first set of mounting blocks connected to the wall facing side of said canvas and a second set of mounting blocks connected to said rabbet in the corners thereof and wherein said first set of mounting blocks and said second set of mounting blocks are constructed and arranged to overlie one another when said canvas in positioned to overlie and cover said opening;

a first magnetic means for detachably mounting said canvas to the front side of said frame operatively associated with at feast some of said first set of mounting blocks and a second magnetic means operatively associated with at least some of said second set of mounting blocks said respective first and second magnetic means being constructed and arranged to cooperate with each other in magnetic attracting relation to maintain the canvas in place over said opening.

13. The frame according claim 12 wherein said first set of mounting blocks comprises a mounting block connected to at least two corners of said frame in the rabbet and wherein said second set of mounting blocks is connected to the wall facing side of said canvas and wherein said second set of mounting blocks is adapted to overlie the corresponding first set of mounting blocks in magnetically attracting relation when said canvas is in place over said opening.

14. The frame according to claim 12 further including a protective covering means comprises a plastic cover having the same profile as said picture frame and wherein said protective covering means is adapted to be positioned in sandwich fashion between said picture frame and said canvas.

15. The frame according to claim 14 wherein said protective covering means is a clear plastic.

16. The frame according to claim 14 wherein said protective covering means is selected from the group consisting of molded plastic, paper, plastic sheeting and clear plastic sheeting.

17. The frame according to claim 12 wherein said magnetic means is selected from the group consisting of magnets, ferrous materials and rare earth magnets.

* * * * *